US011432989B2

(12) United States Patent
Taniguchi et al.

(10) Patent No.: US 11,432,989 B2
(45) Date of Patent: Sep. 6, 2022

(54) INFORMATION PROCESSOR

(71) Applicant: Toyota Jidosha Kabushiki Kaisha, Toyota (JP)

(72) Inventors: Mashio Taniguchi, Toyota (JP); Mariko Higuchi, Toyota (JP); Masatoshi Kakutani, Toyota (JP); Yukiko Ohnishi, Toyota (JP); Hiroaki Kawamura, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/238,723

(22) Filed: Apr. 23, 2021

(65) Prior Publication Data

US 2021/0338517 A1 Nov. 4, 2021

(30) Foreign Application Priority Data

Apr. 30, 2020 (JP) ..... JP2020-080707

(51) Int. Cl.
*A61H 3/06* (2006.01)

(52) U.S. Cl.
CPC ..... *A61H 3/061* (2013.01); *A61H 2003/063* (2013.01); *A61H 2201/5064* (2013.01); *A61H 2201/5084* (2013.01); *A61H 2201/5092* (2013.01); *A61H 2201/5097* (2013.01)

(58) Field of Classification Search
None
See application file for complete search history.

(56) References Cited

U.S. PATENT DOCUMENTS

2013/0250078 A1* 9/2013 Levy ..... A61H 3/061 348/62
2015/0035685 A1* 2/2015 Strickland ..... B60Q 1/525 340/901
2017/0270827 A1* 9/2017 Channabasappa ... G09B 21/007
2019/0254919 A1* 8/2019 Coney ..... A61H 3/061
2019/0307632 A1 10/2019 Yashiro et al.

FOREIGN PATENT DOCUMENTS

WO 2018025531 A1 2/2018

* cited by examiner

*Primary Examiner* — Thomas S McCormack
(74) *Attorney, Agent, or Firm* — Dinsmore & Shohl LLP

(57) ABSTRACT

A controller of a white stick system determines a walking direction of a person who acts without using eyesight based on sensor data acquired from built-in sensors, such as a camera, and generates a first notification to notify the determined walking direction. A wireless communication unit receives information regarding movement of a mobile object present around the person from a data communication module and a mobile terminal. The controller generates a second notification to notify a collision between the person who moves without using eyesight and the mobile object when the collision is predicted based on the information regarding movement of the mobile object.

1 Claim, 12 Drawing Sheets

BOTH HANDS ARE ENGAGED WHEN USER HOLDS ANOTHER DEVICE

WHEN RECEIVING INFORMATION FROM BOTH WHITE STICK AND ANOTHER DEVICE, USER TENDS TO BE CONFUSED.

INFORMATION PROCESSOR

CROSS-REFERENCE TO RELATED APPLICATION

This application claims priority to Japanese Patent Application No. 2020-080707 filed on Apr. 30, 2020, incorporated herein by reference in its entirety.

BACKGROUND

1. Technical Field

The present disclosure relates to an information processor.

2. Description of Related Art

Disclosed in WO2018/025531 is an information processor (for example, a smartphone) including a direction determination unit that determines a walking direction of a person who acts without using eyesight, and a guide information generation unit that generates guide information for the person who acts without using eyesight to walk in the determined direction. In the technique, the direction determination unit determines the walking direction by matching an image photographed with a camera and a reference image stored in advance, and the guide information generation unit calculates a shift amount from the determined direction.

SUMMARY

However, in the technique disclosed in WO2018/025531, there is no mention about detection of mobile objects, such as vehicles. When a mobile object is present around a person who acts without using eyesight, there is a possibility that the mobile object may collide with the person who acts without using eyesight, depending on a moving direction of the mobile object. Accordingly, there is room for improvement in the technique disclosed in WO2018/025531 from a viewpoint of enhancing the safety of the person who acts without using eyesight and the mobile objects present therearound.

The present disclosure has been made in consideration of the above fact, and it is an object of the present disclosure to provide an information processor capable of enhancing the safety of a person who acts without using eyesight and mobile objects present therearound.

An information processor according to a first aspect of the disclosure includes: a direction determination unit configured to determine a walking direction of a person who acts without using eyesight; a reception unit configured to receive information regarding movement of a mobile object present around the person; and a generation unit configured to generate, as a notification to the person who acts without using eyesight, a first notification to notify the walking direction determined by the direction determination unit, and a second notification to notify a collision between the person who acts without using eyesight and the mobile object when the collision is predicted based on the information regarding movement of the mobile object, which is received by the reception unit.

According to the first aspect of the disclosure, the direction determination unit determines a walking direction of a person who moves without using eyesight, and the generation unit generates the first notification to notify the determined walking direction. The reception unit receives information regarding movement of a mobile object present around the person. When a collision between the person who acts without using eyesight and the mobile object is predicted, the generation unit generates a second notification to notify the predicted collision. Hence, when the collision between the person who acts without using eyesight and the mobile object is predicted, it is possible to encourage the person who acts without using eyesight to make an action to avoid collision with the mobile object. Therefore, according to the first aspect of the disclosure, it is possible to enhance the safety of a person who acts without using eyesight and mobile objects present around the person.

The present disclosure demonstrates the effect of making it possible to enhance the safety of a person who acts without using eyesight and mobile objects present around the person.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Figure 1:
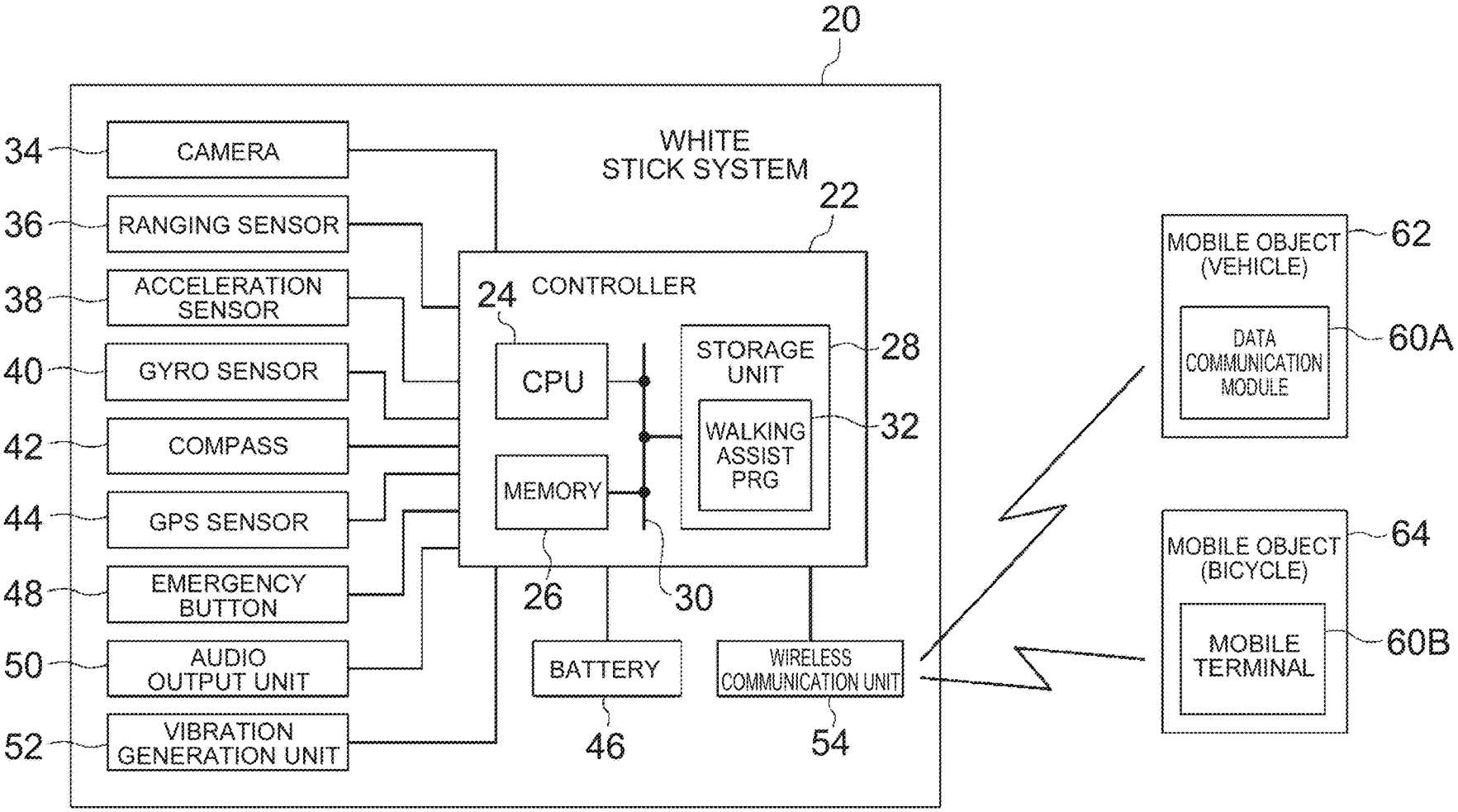
FIG. 1 is a block diagram showing a white stick system incorporated in a grip portion of a white stick device and external communication devices.

Hereinafter, an example of an embodiment of the present disclosure will be described in details with reference to the drawings. FIG. 2A shows a white stick device 10 according to the present embodiment. The white stick device 10 includes a grip portion 14, a white stick portion 12, and a white stick system 20. The white stick portion 12 has a base portion attached to one end portion side of the bottom face of the grip portion 14 (the front side of the white stick device 10). The grip portion 14 incorporates the white stick system 20 shown in FIG. 1. When a user (for example, a visually handicapped person) acts without using eyesight, the user carries the white stick device 10.

As shown in FIG. 2B to FIG. 2F, the grip portion 14 has an approximately box shape with a length direction extending along a front-rear direction of the white stick device 10. In the grip portion 14, corners where the front face and the top face meet are formed in a partially notched shape. On the top face of the grip portion 14, an emergency button 48 (physical button) is provided at a position where a user's finger is placed when the user grips the grip portion 14. The emergency button 48 is pressed by the user in emergency.

On the bottom face of the grip portion 14, a plurality of circular groove portions (recesses) 18 extending along a width direction of the grip portion 14 is provided at an interval in the length direction of the grip portion 14. When the user grips the grip portion 14, the user's fingers enter into the circular groove portions 18, which stabilizes gripping of the grip portion 14 by the user.

The white stick system 20 includes a controller 22 and various kinds of built-in sensors connected to the controller 22. The built-in sensors include a camera 34, a ranging sensor 36, an acceleration sensor 38, a gyro sensor 40, a compass 42, and a global positioning system (GPS) sensor 44.

The controller 22 includes a central processing unit (CPU) 24, a memory 26 such as a read only memory (ROM) or a random access memory (RAM), and a nonvolatile storage unit 28, such as a hard disk drive (HDD) or a solid state drive (SSD). The CPU 24, the memory 26, and the storage unit 28 are communicably connected with each other through an internal bus 30.

The storage unit 28 stores a walking assist program 32. The controller 22 of the white stick system 20 performs a later-described walking assist process by expanding the walking assist program 32 read from the storage unit 28 to the memory 26, and executing the walking assist program 32 expanded to the memory 26 on the CPU 24. Thus, the white stick system 20 functions as an example of the information processor.

Figure 3:
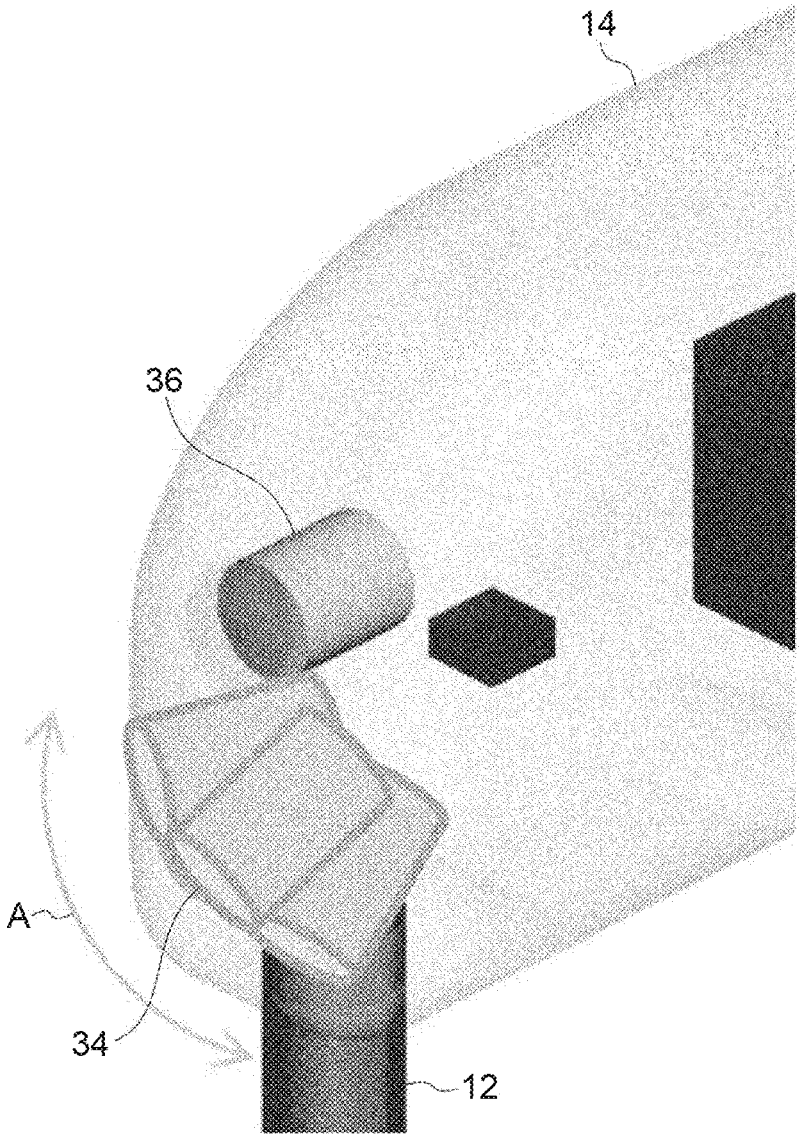
FIG. 3 is a perspective view showing (some part of) the grip portion of the white stick device in an aspect where a camera is supported so as to keep an imaging direction to be a front direction.

The camera 34 receives incoming light through a lens 16 (see FIGS. 2B, 2C, 2D, and 2F) provided on the front face of the grip portion 14. The camera 34 is supported so as to constantly keep an imaging direction to be a front direction of the white stick device 10 by a gimbal not illustrated (also see an arrow A of FIG. 3), and images a front image of the white stick device 10.

The ranging sensor 36 is placed above the lens 16 on the front face of the grip portion 14. The ranging sensor 36 emits light (visible light or infrared light), an electric wave, or an ultrasonic wave to the surrounding of the white stick device 10, and detects a reflected wave so as to obtain a distance to an object present around the white stick device 10 and a position relative to the object.

The acceleration sensor 38 detects a triaxial acceleration. The gyro sensor 40 detects a triaxial angular speed. The compass 42 detects geomagnetism. The GPS sensor 44 receives GPS signals from a plurality of GPS satellites, and detects a position based on the received GPS signals.

The controller 22 is also connected to a battery 46, the emergency button 48, an audio output unit 50, a vibration generation unit 52, and a wireless communication unit 54. The battery 46 supplies electric power to each unit of the white stick system 20. The audio output unit 50 includes a speaker to output sound from the speaker in response to an instruction from the controller 22. The user hears the sound output from the audio output unit 50.

The vibration generation unit 52 includes a plurality of vibrators each formed of a vibrating motor which converts an electrical signal into vibration. The vibrators are provided at positions different from each other in the grip portion 14 (for example, at positions where fingers of the hand of the user are placed when the user grips the grip portion 14 (positions corresponding to the circular groove portions 18) or at positions where the palm is placed). In response to an instruction from the controller 22, the vibrators generate vibration. The vibration generated in the vibrators of the vibration generation unit 52 is sensed by the user who grips the grip portion 14.

The wireless communication unit 54 performs wireless communication of a relatively short distance directly with an external communication device 60 included in a mobile object present around the white stick device 10 without through a base station. When the mobile object is a vehicle 62, the external communication device 60 is a data communication module (DCM) 60A mounted in the vehicle 62. When the mobile object is a bicycle 64, the external communication device 60 is a mobile terminal 60B possessed by a person who pedals the bicycle 64. The wireless communication unit 54 is an example of a reception unit.

The data communication module 60A and the mobile terminal 60B each constantly detect a current location, a moving direction, and a moving speed of their own device. When communicating with the white stick device 10, the data communication module 60A and the mobile terminal 60B transmit these pieces of information to the white stick device 10. The current location, the moving direction, and the moving speed of the data communication module 60A and the mobile terminal 60B received from the data communication module 60A and the mobile terminal 60B are examples of the information regarding movement of the mobile object. When receiving crime preventive information or road construction information from a server not illustrated, the data communication module 60A and the mobile terminal 60B transfer these pieces of information to the white stick device 10.

Figure 4:
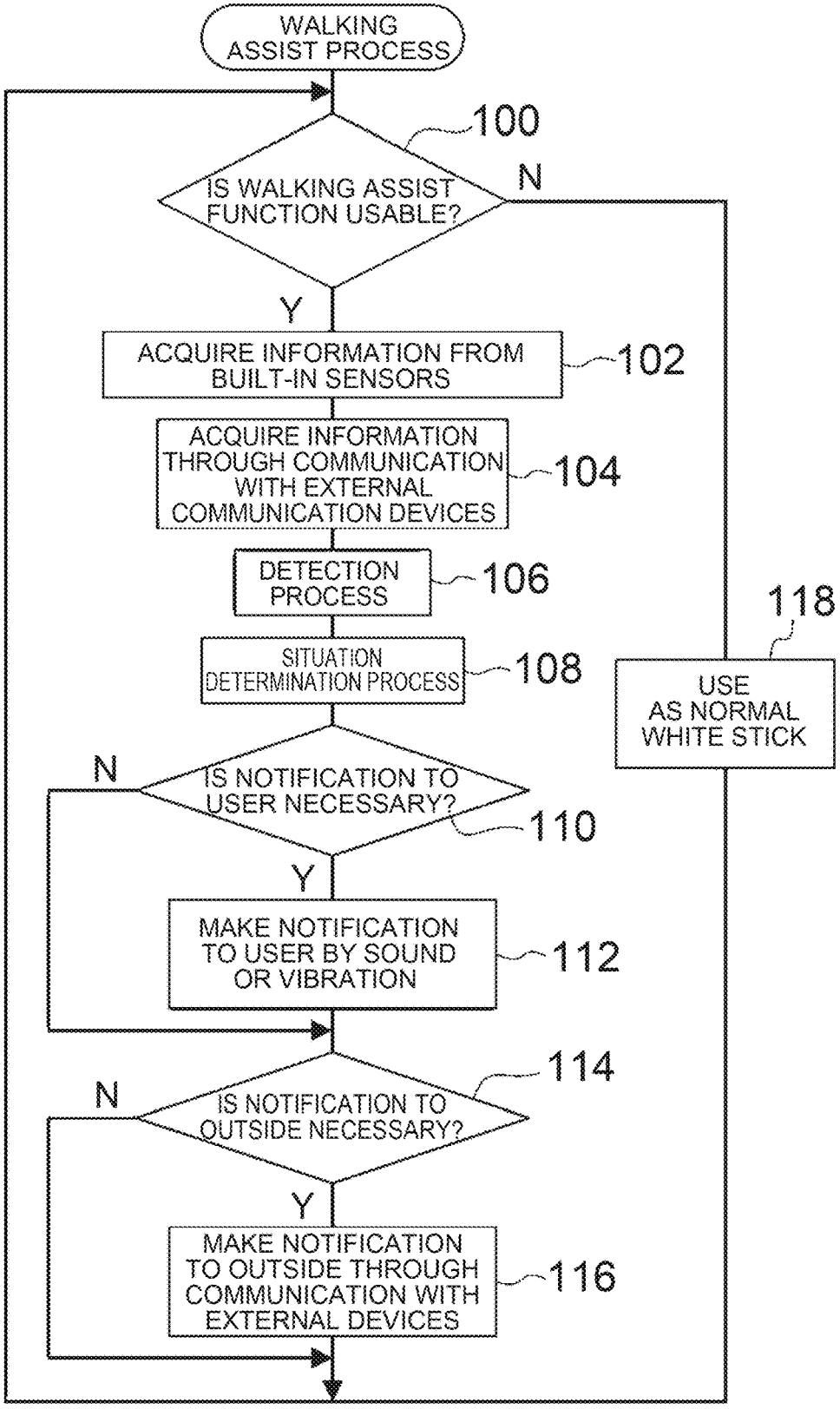
FIG. 4 is a flowchart of a walking assist process executed in a controller of the white stick device.

Next, as the operation of the present embodiment, the walking assist process executed by the controller 22 of the white stick device 10 is first described with reference to FIG. 4. In step 100, the controller 22 determines whether or not the walking assist function by the white stick system 20 can be used. When electric power is supplied to each unit of the white stick system 20 including the controller 22 from the battery 46, and the white stick system 20 functions normally, Yes is determined in step 100, and the process shifts to step 102.

In step 102, the controller 22 acquires sensor data from each of the built-in sensors including the camera 34, the ranging sensor 36, the acceleration sensor 38, the gyro sensor 40, the compass 42, and the GPS sensor 44. In step 104, the controller 22 communicates with the external communication devices 60 (the data communication module 60A of the vehicle 62 and the mobile terminal 60B of the bicycle 64) which are present around the white stick device 10, and acquires various kinds of information from the external communication devices 60.

In step 106, the controller 22 performs a detection process which analyzes the sensor data acquired in step 102. In step 108, the controller 22 performs a situation determination process which determines the situation of the peripheral environment of the white stick device 10 based on the information obtained in the detection process of step 106.

In step 110, the controller 22 determines whether or not a notification to the user is necessary based on the result of determining the situation of the peripheral environment of the white stick device 10 in the situation determination process of step 108. When YES is determined in step 110, the process shifts to step 112. In step 112, the controller 22 makes a notification to the user by outputting a sound corresponding to the content of notification to the user from the audio output unit 50, or generating vibration corresponding to the content of notification to the user by a combination of the vibrators of the vibration generation unit 52. When a notification to the user is unnecessary, NO is determined in step 110, and step 112 is skipped.

In subsequent step 114, the controller 22 determines whether or not a notification to the outside is necessary. Examples of the case where the notification to the outside is necessary may include the case where the user presses the emergency button 48, and the case where the timing of sending a periodic notification regarding the current location of the white stick device 10 to the outside has come. When YES is determined in step 114, the process shifts to step 116. In step 116, the controller 22 transmits to the external communication device 60 the information notified to the outside through communication with the external communication devices 60. When the notification to the outside is unnecessary, NO is determined in step 114, and step 116 is skipped.

When electric power is supplied to each unit of the white stick system 20 including the controller 22 from the battery 46, and the white stick system 20 functions normally, the controller 22 repeats the above steps 100 to 116. Meanwhile, when the battery 46 has no remaining capacity, or when the white stick system 20 fails, the process shifts from step 100 to step 118. In this case, in step 118, the user uses the white stick device 10 as a normal white stick which physically detects an object with the white stick portion 12.

In the present embodiment, the walking assist process described above can implement a plurality of functions listed below. Hereinafter, the functions implemented by the walking assist process will be described in order.

Walking Assist Function

The walking assist function is a function to guide a user who possesses the white stick device 10, so that the user walks along a route registered in advance. To achieve the function, a route registration process is performed in advance.

In the route registration process, the controller 22 periodically collects sensor data from the built-in sensors, such as the camera 34, the ranging sensor 36, and the GPS sensor 44, while the user is walking along the route as a registration target. The controller 22 also searches for indices, such as pedestrian crossings and signaling devices, from images photographed with the camera 34, and adds the search result to the sensor data. The controller 22 then stores the obtained information in the storage unit 28 as route information. As a result of the process, the route information includes information indicating positions of pedestrian crossings, signaling devices, and the like, present on the route.

Hereinafter, an example of the process based on the walking assist function will be described with reference to FIG. 5. The controller 22 determines, in the detection process (step 106) and the situation determination process (step 108), whether or not a pedestrian crossing and a signaling device are present within a prescribed distance from the white stick device 10. The determination process can be achieved by matching the images photographed with the camera 34, or determining whether or not the position detected by the GPS sensor 44 is within a first prescribed distance from the position of the pedestrian crossing and the signaling device, while also using the distance detected by the ranging sensor 36.

Figure 5:
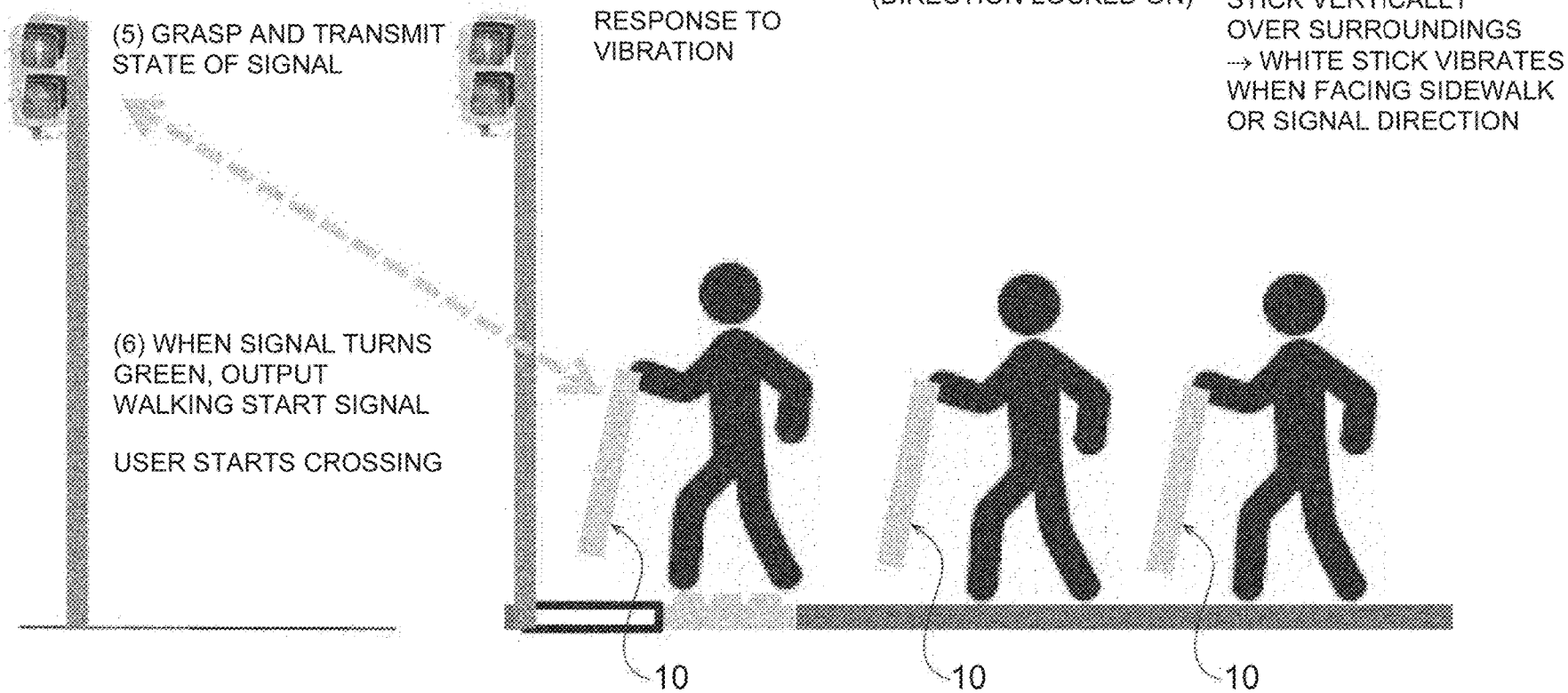
FIG. 5 is an image view for illustrating a walking assist function.

When the pedestrian crossing and the signaling device are present within a prescribed distance from the white stick device 10, the controller 22 determines that a notification to the user is necessary (YES is determined in step 110), and notifies the approach of the pedestrian crossing and the signaling device to the user by sound or vibration as shown in FIG. 5 (1) (step 112). Thus, the user can recognize the approach of the pedestrian crossing and the signaling device.

Next, the controller 22 calculates, in the detection process (step 106) and the situation determination process (step 108), the direction of the pedestrian crossing and the signaling device with the position of the white stick device 10 as a reference, based on the position of the pedestrian crossing and the signaling device. The controller 22 also calculates a matching degree of the direction of the white stick device 10 detected with the compass 42 with respect to the direction of the pedestrian crossing and the signaling device. When the matching degree of the direction of the white stick device 10 with respect the direction of the pedestrian crossing and the signaling device is a prescribed value or more, the controller 22 determines that a notification to the user is necessary (YES is determined in step 110). Then, as shown in FIG. 5 (2), the controller 22 notifies that the white stick device 10 faces toward the direction of the pedestrian crossing and the signaling device by vibration (or sound) to the user (step 112).

Hence, when the user takes an action of holding the white stick device 10 over the surroundings and changes the direction of the white stick device 10, a notification is given to the user at the time when the white stick device 10 faces toward the pedestrian crossing and the signaling device. Therefore, the user can recognize the direction where the pedestrian crossing and the signaling device are present. While the user, who has recognized the direction where the pedestrian crossing and the signaling device are present, walks in the recognized direction, the user is continuously notified that the white stick device 10 faces toward the pedestrian crossing and the signaling device by vibration (or sound). Thus, as shown in FIG. 5 (3), the user can recognize that the user is walking toward the pedestrian crossing and the signaling device.

Next, the controller 22 determines, in the detection process (step 106) and the situation determination process (step 108), whether the white stick device 10 has arrived at a stop position immediately before the pedestrian crossing and the signaling device. The determination process can also be achieved by matching the images photographed by the camera 34, or determining whether or not the position detected by the GPS sensor 44 is within a second prescribed distance (<first prescribed distance) from the position of the pedestrian crossing and the signaling device, while also using the distance detected by the ranging sensor 36.

When the white stick device 10 has arrived at the stop position, the controller 22 determines that a notification to the user is necessary (YES is determined in step 110). Hence, as shown in FIG. 5 (4), the arrival at the stop position is notified to the user by vibration (or sound) (step 112). Thus, the user can recognize the arrival at the stop position, and the user stops walking.

Next, in the detection process (step 106) and the situation determination process (step 108), the controller 22 detects the state of the signaling device by performing image recognition of an image photographed with the camera 34, and determines whether the signaling device is in the state of being changed to green from red. When the signaling device is in other than the state of being changed to green from red, the controller 22 determines that a notification to the user is necessary (YES is determined in step 110). Hence, as shown in FIG. 5 (5), the current state of the signaling device is notified to the user by sound or vibration (step 112). Thus, the user can recognize the state of the signaling device, and the user remains at the stop position.

When the signaling device is in the state of being changed to green from red, the controller 22 determines that the notification to the user is necessary (YES is determined in step 110). Hence, as shown in FIG. 5 (6), the controller 22 encourages the user to start walking by sound or vibration (step 112). Thus, the user can recognize that the signaling device is in the state of being changed to green from red, and the user starts crossing a road on the pedestrian crossing.

Conventionally, the visually handicapped person moves by using contact information between the white stick and the road surface or obstacles as well as surrounding sound as a guide. However, there are cases where braille blocks are provided partially on the surface of the roads, or where some braille blocks are no longer effective due to aging or other reasons. In the case of crossing the roads in particular, there are places not equipped with signaling devices with sound. To cope with these circumstances, the white stick device 10 according to the present embodiment includes the walking assist function as described above. Accordingly, it becomes possible to guide a user possessing the white stick device 10, so that the user walks along a route registered in advance.

In the walking assist function described above, the controller 22 of the white stick system 20 functions as an example of the direction determination unit and the generation unit that generates a first notification. A notification to the user in the walking assist function described above is an example of the first notification.

Function of Avoiding Collision with Mobile Objects

A function of avoiding collision with mobile objects is a function of avoiding collision of the user with mobile objects, such as the vehicle 62, and the bicycle 64, present around the white stick device 10 by communicating with the external communication devices 60 (the data communication module 60A and the mobile terminal 60B) of the mobile objects.

More specifically, the controller 22 communicates with the external communication device 60 of a mobile object present around the white stick device 10 so as to acquire the current location, the moving direction, and the moving speed of the mobile object (step 104). The controller 22 also predicts, in the detection process (step 106) and the situation determination process (step 108), a future moving track (first track) of the mobile object based on the current location, the moving direction, and the moving speed of the mobile object. The controller 22 also predicts a future moving track (second track) of the user who possesses the white stick device 10 based on sensor data, and calculates, for example, a distance between the first track and the second track when the first track and the second track are closest at the same time, as an index corresponding to the probability of collision between the mobile object and the user.

When the probability of collision between the mobile and the user is a prescribed value or more (for example, when the distance between the first track and the second track when the first track and the second track are closest at the same time is less than the prescribed value, i.e., when collision between the user and the mobile object is predicted), the controller 22 determines that a notification to the user is necessary (YES is determined in step 110), and the possibility of collision with the mobile object is notified to the user by sound or vibration (step 112). The notification to the user may be achieved by simply notifying the possibility of collision with the mobile object (outputting an alert) or by guiding the user toward a safer direction for the user, for example, a direction 90 degrees different from the direction that the mobile object approaches. Thus, the user can recognize the possibility of collision with the mobile object, and the user is encouraged to take an action of avoiding the collision with the mobile object.

Although the technique disclosed in WO2018/025531 detects the signaling devices and the like, there is no mention about detection of mobile objects, such as vehicles present around a user. Therefore, the collision with the mobile objects present around the user hinders safe movement of the user. As a solution, the white stick device 10 according to the present embodiment includes the function of avoiding collision with mobile objects described above. Accordingly, it is possible to detect the approach of mobile objects, such as vehicles present around the user, and outputs an alert, or guide the user to a safer side. This makes it possible to enhance the safety of the user and the mobile objects present around the user.

In the function of avoiding collision with mobile objects described above, the controller 22 of the white stick system 20 functions as an example of the generation unit that generates a second notification. A notification to the user in the function of avoiding collision with mobile objects described above is an example of the second notification.

Emergency Reporting Function

An emergency reporting function is a function of transmitting emergency information to a prescribed emergency contact (for example, a third party such as emergency medical service or the police) through the external communication device 60, such as the data communication module 60A and the mobile terminal 60B, when a user presses the emergency button 48 in emergency. Examples of the case where the user presses the emergency button 48 may include the case where the user becomes sick, the case where the user is involved in an accident, the case where the user loses his or her way, and the case where the user encounters an attacker or the like. The function can secure the safety of the user in emergency.

The technique disclosed in WO2018/025531 is premised on use of a smartphone. However, it is difficult for those visually handicapped to perform operations such as a flick operation, a swipe operation, or an operation of pushing an icon on the smartphone. In the present embodiment, a physical button (emergency button 48) is provided at the place on the grip portion 14 of the white stick device 10 where a finger of the user are placed when the user grips the grip portion 14. This ensures that the user can operate the button.

Guardian Watching Function

A guardian watching function is a function of periodically transmitting the current location of the white stick device 10 (user) detected by the GPS sensor 44 to the mobile terminal possessed by a guardian of the user through the external communication devices 60, such as the data communication module 60A and the mobile terminal 60B, whenever a preset time elapses. The function allows the guardian to ascertain the current location of the user, and confirm the safe action of the user.

Function of Notifying Crime Preventive Information

A function of notifying crime preventive information is a function of receiving crime preventive information, announced from the police station that patrols the area where the white stick device 10 is positioned, through the external communication devices 60 such as the data communication module 60A and the mobile terminal 60B, and notifying the content of the received crime preventive information to the user by sound. The received crime preventive information may be used in the walking assist function described above for the process of correcting a walking guide route so as to avoid walking through the area where the pertinent crime has occurred. The function enables the user to take an appropriate action to avoid danger based on the notified crime preventive information.

Function of Notifying Construction Information

A function of notifying construction information is a function of receiving construction information on a road (sidewalk) in the area where the white stick device 10 is positioned through the external communication devices 60, such as the data communication module 60A and the mobile terminal 60B, and notifying the information to the user by sound or vibration. The received construction information may be used in the walking assist function described above for the process of correcting a walking guide route so as to avoid walking on the sidewalk where construction work is performed. The function enables the user to take an appropriate action to avoid danger based on the notified construction information.

Other Operational Effects

In the technique disclosed in WO2018/025531, mobile communication involving communication with a base station is applied to the communication between a smartphone and the outside. In the mobile communication, one base station covers a relatively large base station area. In the base station area, it is needed to perform wireless communication with the same base station, and therefore a lot of electric power is consumed. When the remaining capacity of a battery become zero and mobile communication is lost, the smartphone becomes unusable.

Figure 6:
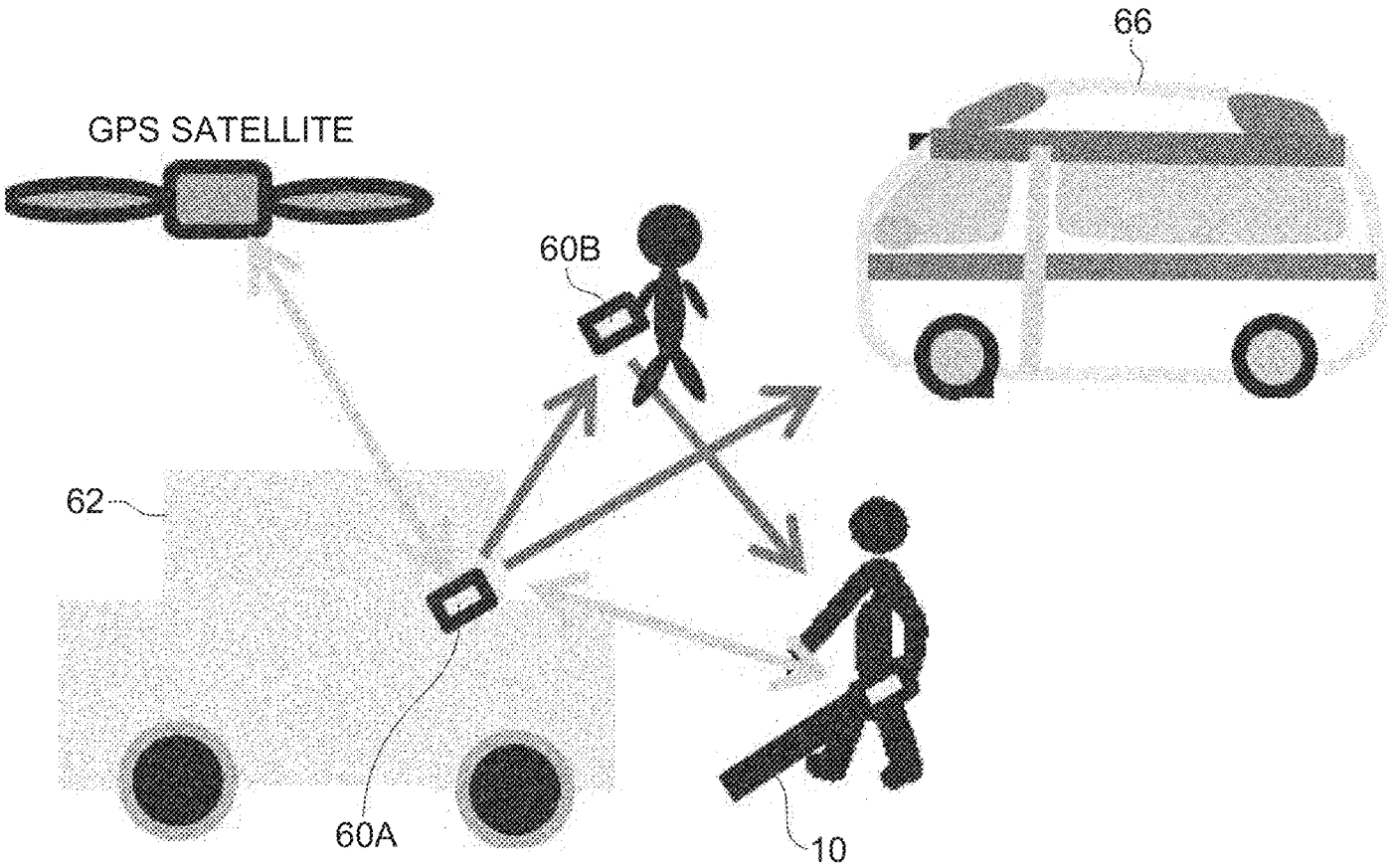
FIG. 6 is an image view for illustrating emergency information to be transmitted to a prescribed emergency contact, such as emergency medical service, through external communication devices.

To cope with this situation, in the white stick device 10 according to the present embodiment, the wireless communication unit 54 directly performs wireless communication of a relatively short distance with the external communication devices 60 included in mobile objects present around the white stick device 10 without through a base station. For example, as shown in FIG. 6, when the user presses the emergency button 48 in emergency, and emergency information is transmitted to a prescribed emergency contact (a third party such as emergency medical service: in FIG. 6, an ambulance 66 is shown as an example), the emergency information is transmitted through the external communication device 60 such as the data communication module 60A by using the mobile communication function of the external communication device 60.

Thus, the electric power consumed in the wireless communication by the wireless communication unit 54 of the white stick device 10 can be reduced. Furthermore, with power saving achieved in the wireless communication, a drop of remaining capacity of the battery 46 is reduced, and thereby the risk of loss of communication can be decreased. It also becomes possible to reduce size and weight of the battery 46 in the prospect of power saving in the wireless communication. In this case, it is possible to achieve improvement in a degree of freedom in design of the white stick device 10 and reduction of user's fatigue.

When the wireless communication unit 54 performs communication through the external communication devices 60, it becomes possible to utilize the GPS sensor with a relatively high accuracy mounted in the external communication device 60. As a result, it also becomes possible to use a sensor, which is power saving though the accuracy is relatively low, as the GPS sensor 44 mounted in the white stick device 10. For example, when the accuracy of the GPS sensor 44 of the white stick device 10 is relatively low in the case of transmitting emergency information to a prescribed emergency contact through the external communication device 60, it becomes possible to transmit high-accuracy location information to the prescribed emergency contact based on latest positional relationship between the external communication device 60 and the user (white stick device 10).

Although the technique disclosed in WO2018/025531 is premised on use of a smartphone, the visually handicapped person is unable to visually recognize an object. Hence, it is difficult for the visually handicapped person to hold the smartphone so as to put an object (a signaling device, a pedestrian crossing) within the field angle of a camera. To overcome this difficulty, in the white stick device 10 according to the present embodiment, the camera 34 is supported by a gimbal so as to constantly keep an imaging direction of the camera 34 to be a front direction of the white stick device 10. Accordingly, it is possible to put an object within the field angle of the camera 34, without the necessity of operation by the user.

Moreover, in the white stick device 10 according to the present embodiment, recesses (circular groove portions 18) are provided at positions on the bottom face of the grip portion 14 where fingers of the hand of the user are placed when the user grips the grip portion 14. A plurality of vibrators of the vibration generation unit 52 are provided on the grip portion 14 at positions where fingers of the hand of the user are placed or at positions where the palm is placed when the user grips the grip portion 14. The vibrators are configured to transmit different information to the user by a combination of vibrations from the vibrators. With the recesses of the grip portion 14, the user can grip the grip portion 14 stably in a generally constant gripping state. Since the gripping state of the grip portion 14 is stabilized, erroneous recognition of the information transmitted by a combination of vibrations becomes less likely to occur.

Although the technique disclosed in WO2018/025531 is premised on use of a smartphone, the smartphone has a general-purpose design so as to be usable for various applications. Hence, sound and vibration generated in the smartphone is not easy to understand for the user. When the user erroneously interprets a guidance, the user may incorrectly be guided to dangerous situations (involving, for example, falls or going out to a driveway).

As a solution, in the white stick device 10 according to the present embodiment, the grip portion 14 is formed into the shape on the premise of being gripped. The vibrators of the vibration generation unit 52 are also placed three-dimensionally at positions where the fingers or the palm of the hand are located when the user grips the grip portion 14. Thus, it becomes possible to guide the user in tactile and intuitive manners for the user. This makes it possible to prevent the user from erroneously interpreting the guidance and to prevent the user from falling into dangerous situations.

Figure 7A:
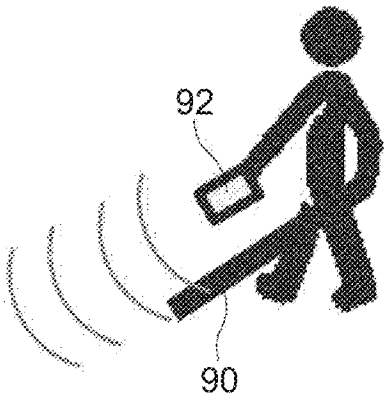
FIG. 7A is an image view for illustrating an issue of the background art.

When a visually handicapped person walks, the person is obliged to use a white stick or a guide dog for safety. However, in the technique disclosed in WO2018/025531, when, for example, a user holds a smartphone 92 by the hand not used for holding the white stick 90, the user needs to walk with both the hands engaged as shown in FIG. 7A as an example. Hence, it is hard for the user to advance while touching walls, obstacles, and the like, by the hand not used to hold the white stick 90. Since both the hands are engaged, the user is unable to hold an umbrella in case of rainy weather.

Figure 7B:
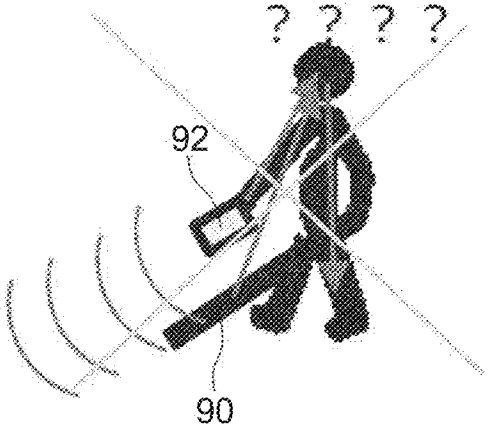
FIG. 7B is an image view for illustrating an issue of the background art.

As shown in FIG. 7B, in the technique disclosed in WO2018/025531, when a user walks while holding the smartphone 92 in addition to the white stick 90, the user receives both the information from the white stick 90 and the information from the smartphone 92 in a separate manner. Accordingly, the user needs to walk while arranging the information from the white stick 90 and the information from the smartphone 92 in his or her head, which makes the user feel tired and troubled.

Figure 7C:
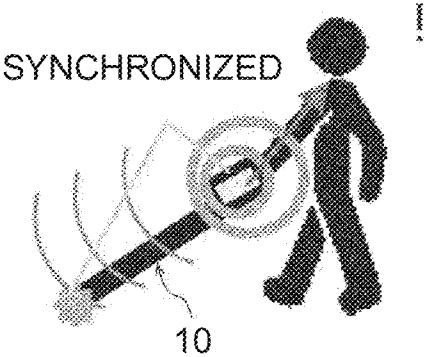
FIG. 7C is an image view for describing the effect of the white stick device of the embodiment.

As a solution, in the white stick device 10 according to the present embodiment, the white stick portion 12 is integrated with the grip portion 14 incorporating the white stick system 20. Hence, the user can safely and comfortably walk without both the hands being engaged. The white stick system 20 also includes the function of performing the detection process, the situation determination process, and the process of notifying the user. As shown in FIG. 7C, since the information in cooperation and synchronization with information from the white stick portion 12 (through touch and vibration from a distal end) is transmitted to the user, the user can intuitively obtain the information, which makes the user less tired and troubled.

In the white stick device 10 according to the present embodiment, the white stick system 20 is incorporated in the grip portion 14 that is integrated with the white stick portion 12. With this configuration, even in the case where the remaining capacity of the battery 46 becomes zero or the white stick system 20 malfunctions due to failure of the white stick system 20, the user can still walk using the white stick device 10 as a conventional white stick.

Other Embodiments

The white stick device 10 is not limited to the configuration described in the embodiment disclosed.

Figure 8B:
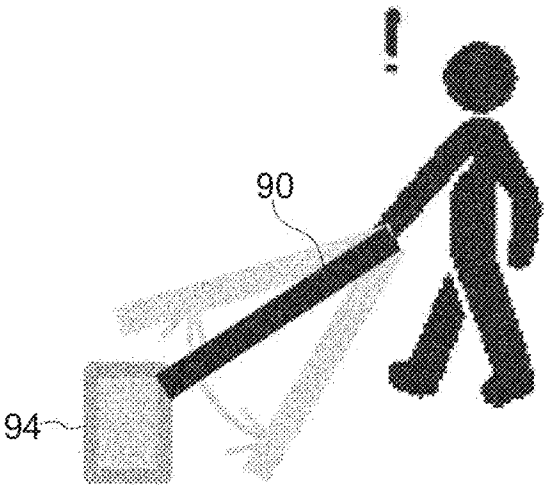
FIG. 8B is an image view for illustrating an issue in the case of using a conventional white stick.
Figure 8A:
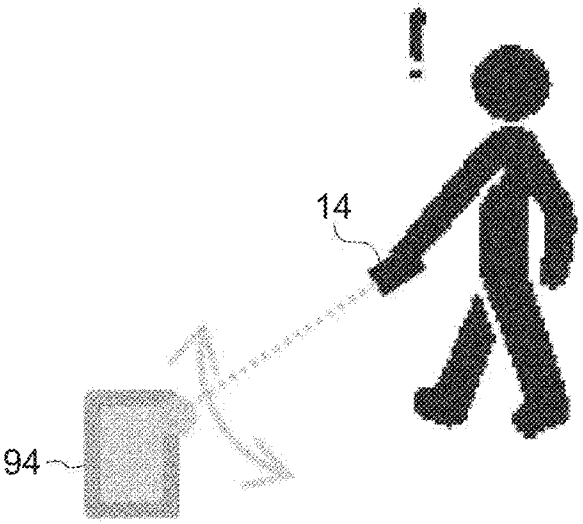
FIG. 8A is an image view for illustrating a tactile sense reproduction function.

For example, the white stick portion 12 of the white stick device 10 may be designed to be storable or foldable. As shown in FIG. 8A, the white stick device 10 may include a function (tactile sense reproducing function) of reproducing, by the vibrators of the vibration generation unit 52, tactile feedback (haptics) corresponding to the sensation when the white stick comes into contact with an object 94, such as a road surface, an obstacle, or the like, based on the result of measuring distance by the ranging sensor 36, in the state where the white stick portion 12 is stored or folded up.

In the technique disclosed in WO2018/025531, signaling devices or the like are recognized by a smartphone, while road surface and periphery information is obtained using a conventional white stick. As shown in FIG. 8B, the conventional white stick 90 physically detects the object 94. Hence, the conventional white stick 90 has the risk of injury and damage to property due to contact between the white stick 90 and the object 94.

As a solution, in the tactile sense reproducing function, tactile feeling as if the conventional white stick 90 comes into contact with the object 94 is reproduced by feeding back the tactile feeling by a combination of the vibrators of the vibration generation unit 52 through the grip portion 14. Thus, information same as the information acquired by the conventional white stick 90 can be acquired without using the conventional white stick 90, which makes it possible to walk without using the conventional white stick 90. It is also possible to reduce the risk of injury and damage to property due to contact with the object 94.

Figure 9:
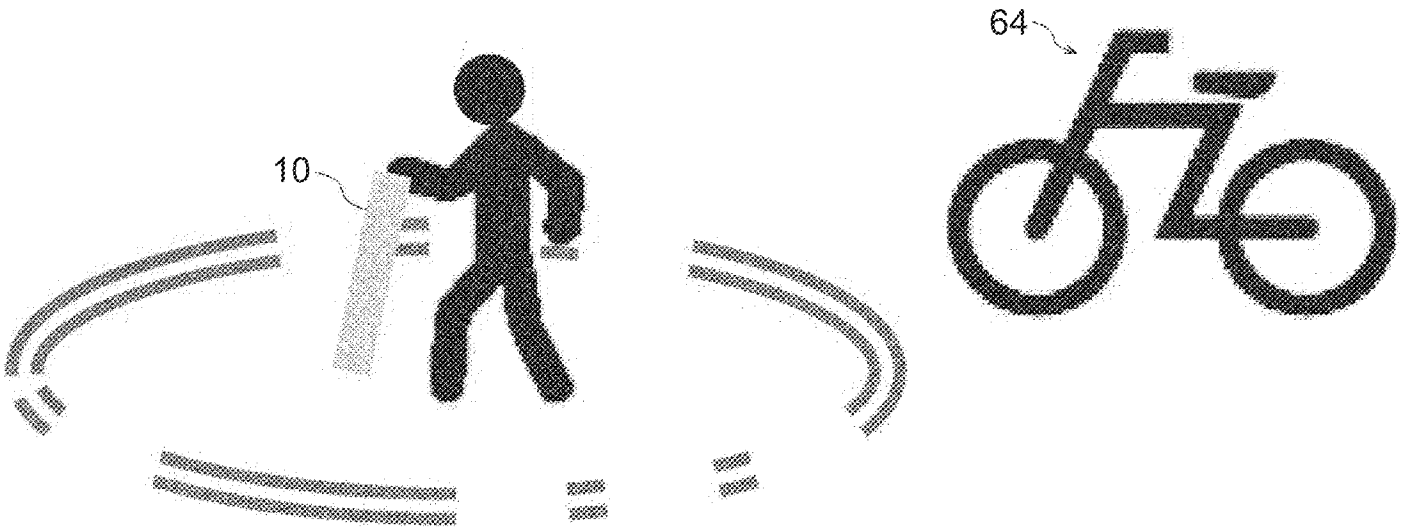
FIG. 9 is an image view for illustrating an aspect where the white stick device projects a light beam serving as a landmark to a surrounding road surface.

As shown in FIG. 9, the white stick device 10 may include a function of avoiding collision by projecting a light beam serving as a landmark to a surrounding road surface from the white stick device 10 and notifying the presence of the user of the white stick device 10 to vehicles, bicycles, pedestrians, and the like, traveling around the user of the white stick device 10. The function can further reduce the probability that the user collides with mobile objects or the like.

Figure 10:
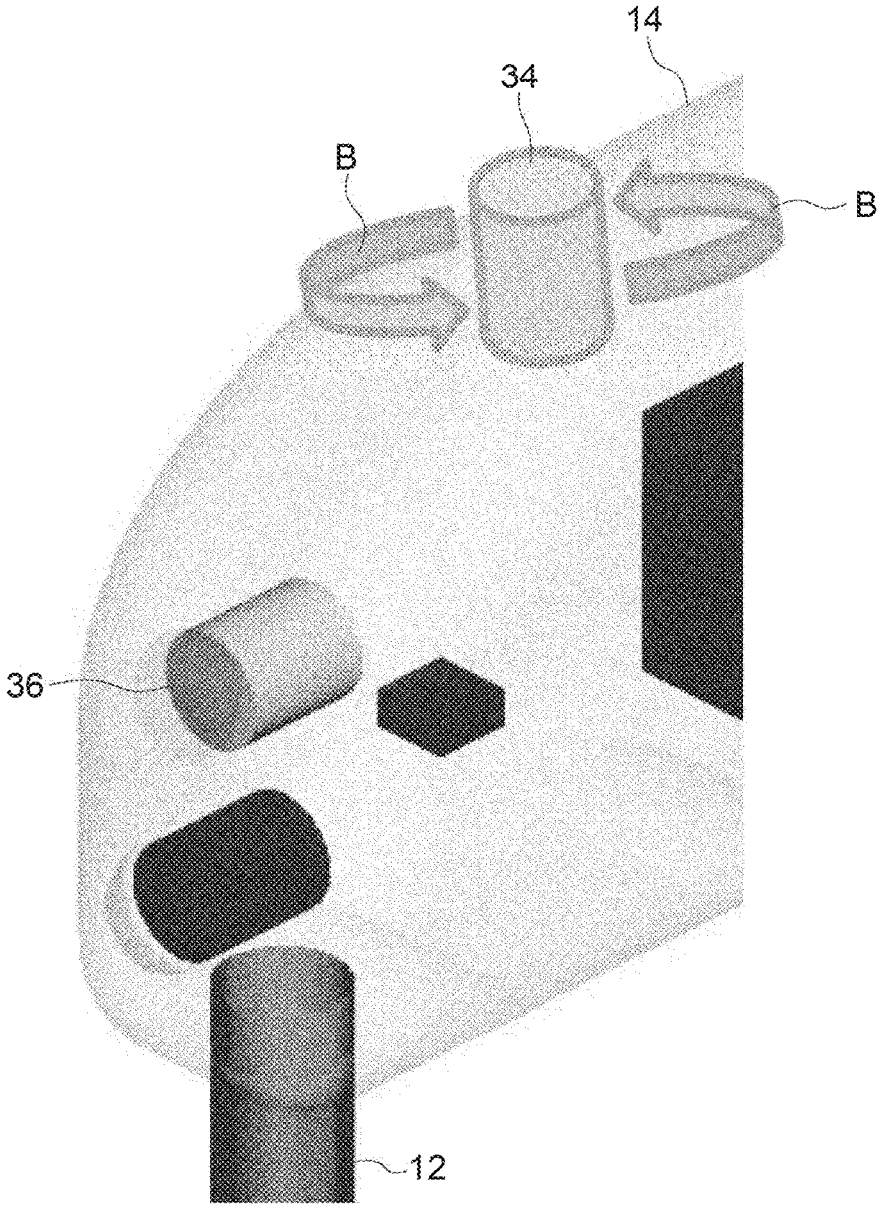
FIG. 10 is a perspective view showing another configuration for imaging a front image with a camera.
Figure 11:
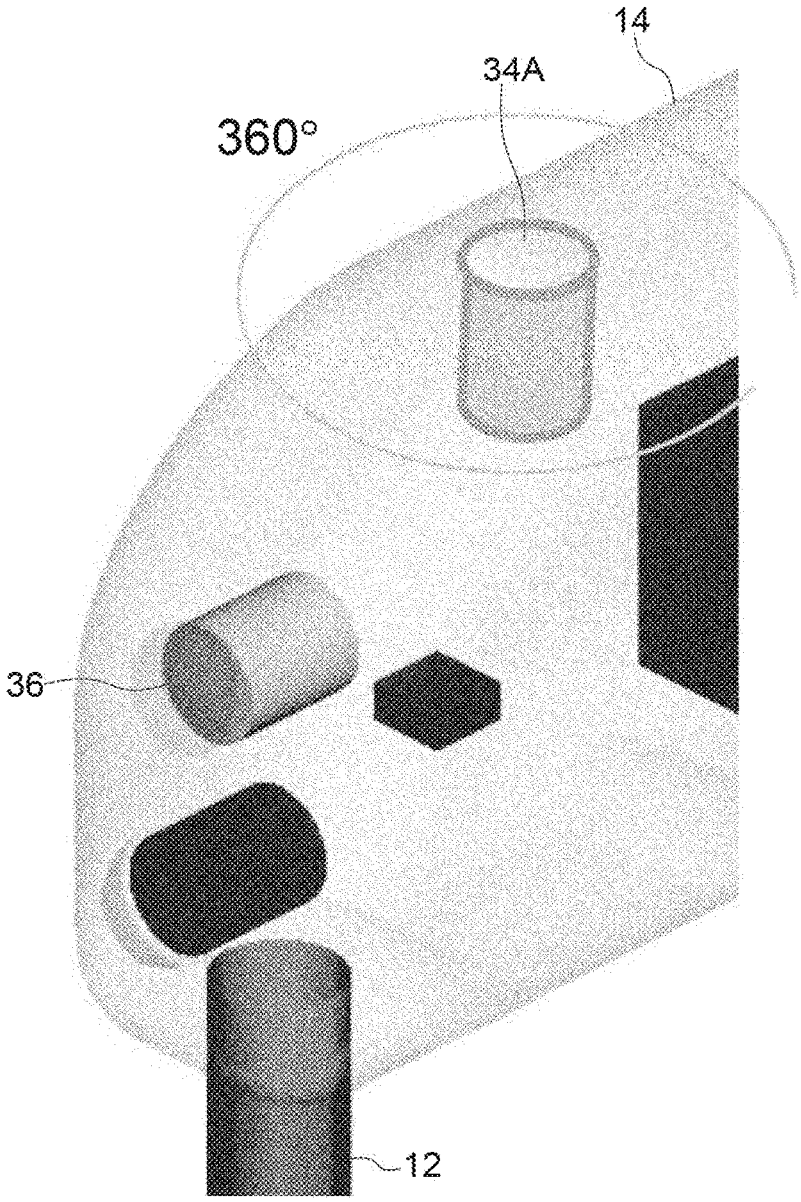
FIG. 11 is a perspective view showing another configuration for imaging a front image with a camera.

In the above description, the configuration in which the camera 34 is supported by a gimbal so as to constantly image a front image has been described. However, the present disclosure is not limited to the configuration. For example, the present disclosure may adopt a configuration including a driving unit that changes the direction of the camera 34 with drive force of a motor or the like as shown by an arrow B in FIG. 10. In the configuration, the gyro sensor 40, or the like, detects the posture of the white stick device 10, and the driving unit adjusts the direction of the camera 34 so as to constantly image a front image. For example, as shown in FIG. 11, a wide angle camera 34A capable of omnidirectional photographing at 360 degrees may be used for photographing.

Furthermore, in the above description, the aspect where the grip portion 14 of the white stick device 10 has an approximately box shape with a length direction extending along a front-rear direction of the white stick device 10 has been described. However, the grip portion 14 is not limited to the shape and configuration shown in FIGS. 2B to 2F. As an example, FIG. 12A, FIG. 12B and FIG. 12C show a grip portion 70 having an approximately long shape with a length direction being inclined toward the rear side of the white stick device 10 with respect to the length direction of the white stick portion 12.

Figure 12C:
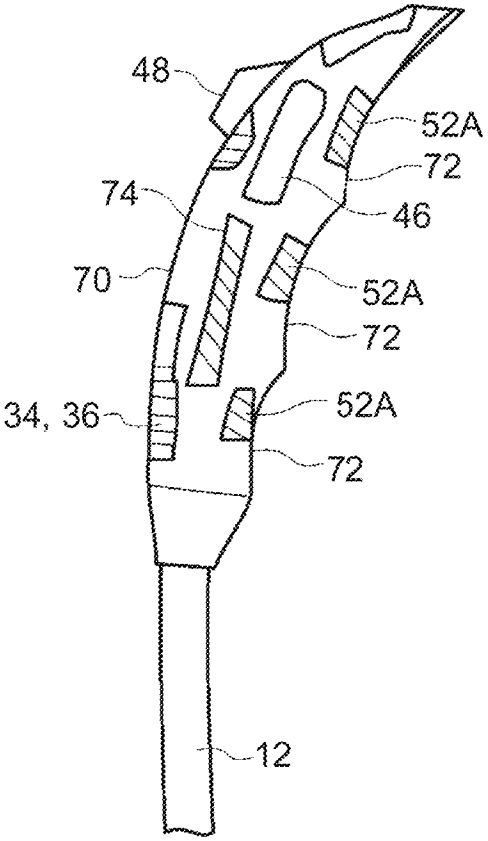
FIG. 12C is an internal configuration view showing the another shape and configuration of the grip portion of the white stick device.
Figure 12B:
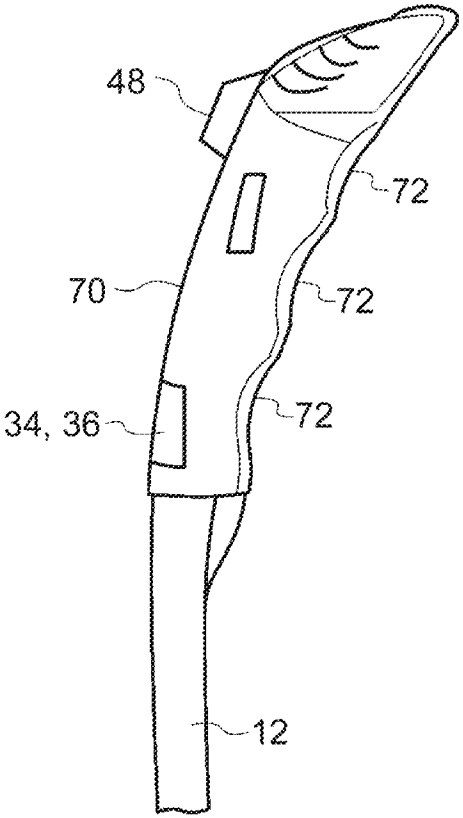
FIG. 12B is a side view showing the another shape and configuration of the grip portion of the white stick device.
Figure 12A:
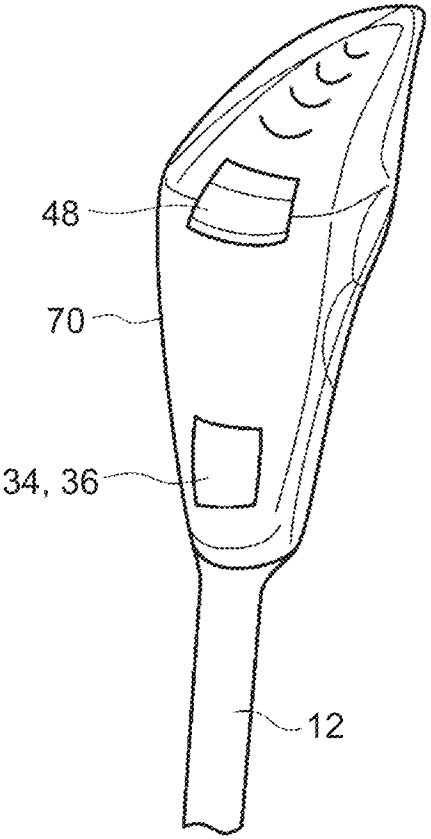
FIG. 12A is a front view showing another shape and configuration of the grip portion of the white stick device.

In the grip portion 70 shown in FIG. 12A, FIG. 12B and FIG. 12C, the camera 34 and the ranging sensor 36 are placed on the front side in the vicinity of a lower end portion that is a joint portion joining with the white stick portion 12. On the front side in the vicinity of an upper end portion of the grip portion 70, a speaker of the audio output unit 50 is placed. On the front side of an intermediate portion of the grip portion, the emergency button 48 is provided. On the rear face of the grip portion 70, a plurality of recesses 72 are formed at positions where fingers of a user are located when the user grips the grip portion 70, and vibrators 52A of the vibration generation unit 52 are placed at positions corresponding to the bottoms of the recesses 72, respectively. In the inside of the grip portion 70, a substrate 74 and a battery 46 are provided. The grip portion 70 of the white stick device 10 may have such configuration.

Although the aspect of making a notification to the user by sound and vibration has been described in the foregoing, the present disclosure is not limited to the aspect. A notification to the user may be made by other means such as generating heat with a heating wire.

Figure 2E:
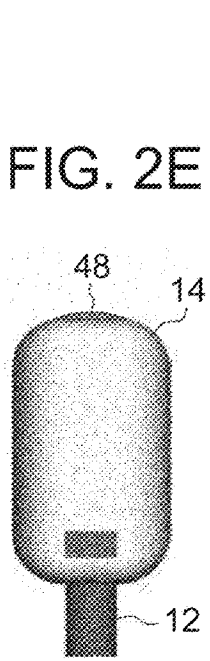
FIG. 2E is a rear view of the grip portion of the white stick device.
Figure 2B:
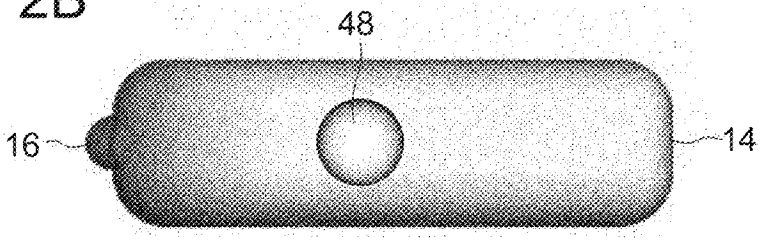
FIG. 2B is a top view of the grip portion of the white stick device.
Figure 2D:
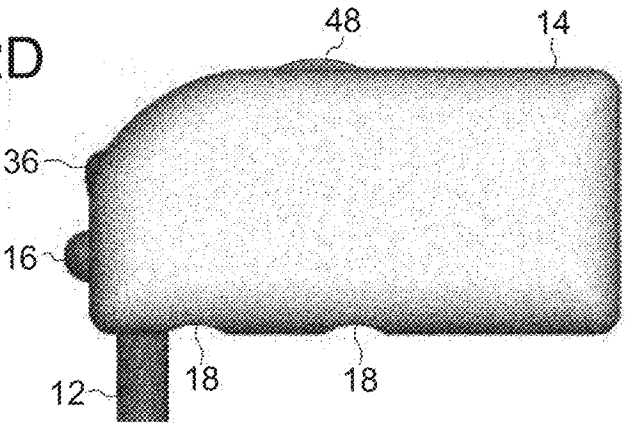
FIG. 2D is a side view of the grip portion of the white stick device.
Figure 2F:
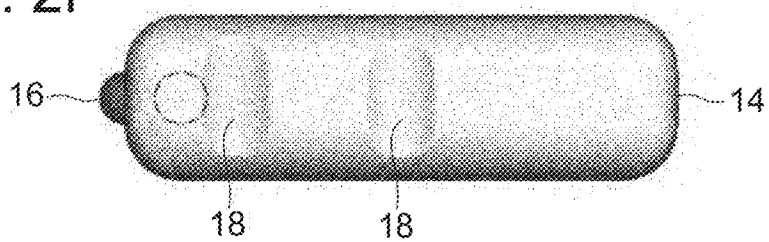
FIG. 2F is a bottom view of the grip portion of the white stick device.
Figure 2C:
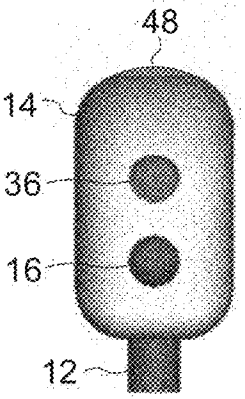
FIG. 2C is a front view of the grip portion of the white stick device.
Figure 2A:
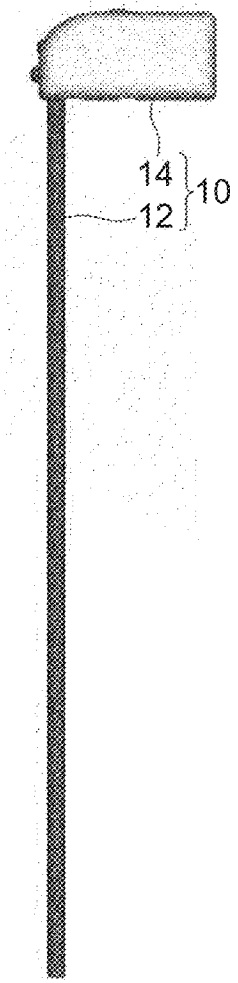
FIG. 2A is a side view of the white stick device.

The white stick system 20 that is incorporated in the grip portion 14 of the white stick device 10 is not limited to the configuration shown in FIG. 1. For example, an infrared sensor, a thermometer, a microphone, or the like, may be mounted on the white stick system 20. For example, the white stick system 20 may also include an interface connectable with external sensors, such as an actinometer, and a hygrometer, or may include a function of notifying information to the user through connection with a device such as an earphone.

In the above description, the aspect where the white stick system 20 which functions as the information processor according to the present disclosure is incorporated in the grip portion 14 of the white stick device 10 including the white stick portion 12 has been described. However, the present disclosure is not limited to the aspect. A mobile terminal, such as a smartphone, may be made to function as the information processor according to the present disclosure.

What is claimed is:

1. A white stick device configured to:

receive images captured by a camera of the white stick device;

search for pedestrian crossings and signaling devices in the images;

store route information including positions of pedestrian crossings and signaling devices;

determine whether a pedestrian crossing or a signaling device is within a predetermined distance from the white stick device;

upon determination that a pedestrian crossing or a signaling device is within the predetermined distance, notify a user of approach of the pedestrian crossing or the signaling device;

calculate a direction of the pedestrian crossing and the signaling device with respect to the white stick device;

calculate a matching degree of a direction of the white stick device with respect to the direction of the pedestrian crossing and the signaling device; and when the matching degree is greater than or equal to a predetermined threshold value, notify the user that the white stick device faces the direction of the pedestrian crossing and the signaling device.

* * * * *